US009163892B1

(12) United States Patent
Buboltz

(10) Patent No.: US 9,163,892 B1
(45) Date of Patent: Oct. 20, 2015

(54) MUZZLE BREAK WITH SUPERSONIC NOZZLE

(71) Applicant: David C. Buboltz, Cary, NC (US)

(72) Inventor: David C. Buboltz, Cary, NC (US)

( * ) Notice: Subject to any disclaimer, the term of this patent is extended or adjusted under 35 U.S.C. 154(b) by 0 days.

(21) Appl. No.: 14/557,821

(22) Filed: Dec. 2, 2014

(51) Int. Cl.
*F41A 21/36* (2006.01)
*F41A 21/28* (2006.01)

(52) U.S. Cl.
CPC ..... *F41A 21/36* (2013.01); *F41A 21/28* (2013.01)

(58) Field of Classification Search
USPC ..... 89/14.3, 14.2, 14.4
See application file for complete search history.

(56) References Cited

U.S. PATENT DOCUMENTS

| | | | | |
|---|---|---|---|---|
| 2,985,074 | A | 5/1961 | Musser | |
| 3,368,453 | A | 2/1968 | Shaw | |
| 3,492,912 | A | 2/1970 | Ashbrook | |
| 3,714,864 | A | 2/1973 | Thierry | |
| 4,020,741 | A | 5/1977 | Junker | |
| 4,307,652 | A | 12/1981 | Witt et al. | |
| 4,404,887 | A * | 9/1983 | Piesik | F41F 3/0455 89/1.703 |
| 4,594,933 | A | 6/1986 | Bell | |
| 5,063,827 | A | 11/1991 | Williamson | |
| 6,308,608 | B1 | 10/2001 | Eisenman | |
| 6,578,462 | B1 * | 6/2003 | Franchino | F41A 21/36 89/14.2 |
| 7,530,299 | B1 * | 5/2009 | Poff | F41A 21/36 42/1.06 |
| 7,581,482 | B1 * | 9/2009 | Cler | F41A 21/36 89/14.3 |
| 8,047,115 | B2 | 11/2011 | Noveske | |
| 8,800,419 | B1 * | 8/2014 | Walker | F41A 21/36 89/14.3 |
| 2011/0252952 | A1 * | 10/2011 | McNeill | F41A 21/38 89/14.3 |
| 2013/0025439 | A1 | 1/2013 | Orton | |

* cited by examiner

*Primary Examiner* — J. Woodrow Eldred
(74) *Attorney, Agent, or Firm* — Coats & Bennett, PLLC

(57) ABSTRACT

A muzzle brake mounts to the barrel of a gun and reduces the recoil when the gun is fired. The muzzle brake comprises a supersonic nozzle including an expansion chamber configured to accelerate the propellant gases exiting the barrel of the gun and a reverser plate to at least partially reverse the flow of the propellant gases to reduce or mitigate recoil.

16 Claims, 9 Drawing Sheets

MUZZLE BREAK WITH SUPERSONIC NOZZLE

TECHNICAL FIELD

The present disclosure relates generally to the field of gun accessories and, more particularly, to muzzle brakes for reducing the recoil of a gun.

BACKGROUND

Muzzle brakes are devices that redirect combustion gases exiting the barrel of a gun in order to reduce the recoil and unwanted rising of the barrel. When a gun is fired, rapidly expanding gases caused by burning powder propel the bullet forwardly. According to Newton's Third Law, an equal force is exerted in the rearward direction and it is felt as recoil by the gun user. The amount of the recoil is a function of the total mass and velocity of the bullet and propellant gases. Muzzle brakes operate by redirecting the propellant gases exiting the gun barrel to minimize or eliminate the contribution of the propellant gases to the recoil. Reducing the recoil makes the gun more controllable and is particularly useful in automatic or rapid fire weapons.

Muzzle brakes have been used on guns for decades, but there is a limit to their effectiveness. The total mass of the propellant gases exiting the gun barrel is much less than the mass of the bullet. Even assuming that 100% of the propellant gases could be redirected in a reverse direction, the recoil forces would not be eliminated. Of course, complete redirection of the propellant gases is not possible and the best designs reduce recoil by only about 35%.

Accordingly, there is a need for improvements in muzzle brakes that can achieve reduction in recoil by more than 35%.

SUMMARY

The present disclosures relates to an improved muzzle brake for guns to reduce recoil. In embodiments of the present disclosure, the muzzle brake incorporates a supersonic nozzle to accelerate the propellant gases exiting from the barrel of the gun. A reverser plate redirects the propellant gases exiting from the barrel of the gun so that the net contribution of the propellant gases to the recoil is negative. When the contribution of the propellant gases to the recoil is negative, accelerating the propellant gases not only eliminates any contribution of the propellant gases to the recoil, but also offsets a portion of the recoil attributable to the bullet. Thus, the combination of a supersonic nozzle to accelerate the velocity of the propellant gases with a reverser plate configured to reverse the flow of propellant gases results in a greater reduction in recoil as compared to prior art designs.

In one exemplary embodiment, the muzzle brake comprises a supersonic nozzle adapted to be attached to the end of a gun barrel and a reverser plate. The supersonic nozzle comprises an expansion chamber having an inlet and an outlet. The expansion chamber is configured to accelerate gases exiting the end of the barrel when the gun is fired. A reverser plate is spaced from the supersonic nozzle and is configured to redirect the flow of propellant gases exiting the supersonic nozzle. An opening in the reverser plate permits the bullet exiting the barrel to pass through the reverser plate. An annular opening between the supersonic nozzle and the reverser plate enables the escape of propellant gases. The nozzle and reverser plate are configured so that the propellant gases negatively contribute to the recoil, i.e., the axial component of the propellant gas flow is negative.

In some embodiments, the expansion chamber has a continuously diverging wall. The wall of the expansion chamber may be bell-shaped and have a variable angle of divergence. In one embodiment, the expansion chamber includes a first section having a convexly curved wall and a second section having a concavely curved wall. IN other embodiments, the wall of the expansion chamber may be conical and have a constant angle of divergence.

In some embodiments, the interior volume of the expansion chamber is free of any internal structure. In other embodiments, a volume defined by a forward protection of the expansion chamber outlet extending to the reverser plate is free of any internal structure. In some embodiments, both the interior volume of the expansion chamber and a volume defined by a forward protection of the expansion chamber outlet extending to the reverser plate are free of any internal structure.

In some embodiments, the nozzle of the muzzle brake incudes a plurality of radial openings to allow passage of propellant gases, said radial openings arranged so that the propellant gases exiting the radial openings form an air curtain to reduce a blast effect of the brake muzzle.

In some embodiments, the muzzle brake further includes an outlet section extending forward from the expansion chamber. The outlet section includes an exit opening having a diameter equal to or greater than a diameter of the outlet of the expansion chamber.

In some embodiments, the outlet section may include a plurality of radial openings to allow passage of propellant gases from an interior of the nozzle to the outside. The gas jets exiting the radial openings form an air curtain to reduce a blast effect of the muzzle brake.

In some embodiments, the outlet section may include a beveled outer surface adjacent the annular opening and extending radially outward for directing propellant gases away from a user.

In some embodiments, the muzzle brake further comprises a plurality of supports for supporting the reverser plate in spaced relationship to the end of the nozzle. The supports project radially outward and forward from the nozzle so that the supports are disposed outside of the space defined by the forward projection of expansion chamber outlet.

In some embodiments, the reverser plate is removable mounted to the nozzle. The reverser plate may have a generally circular configuration with an outer diameter greater than a diameter of the exit opening of the nozzle. The reverser plate may also have a concave inner surface configured to redirect the flow of propellant gases in a partially rearward direction.

DETAILED DESCRIPTION

Figure 1:
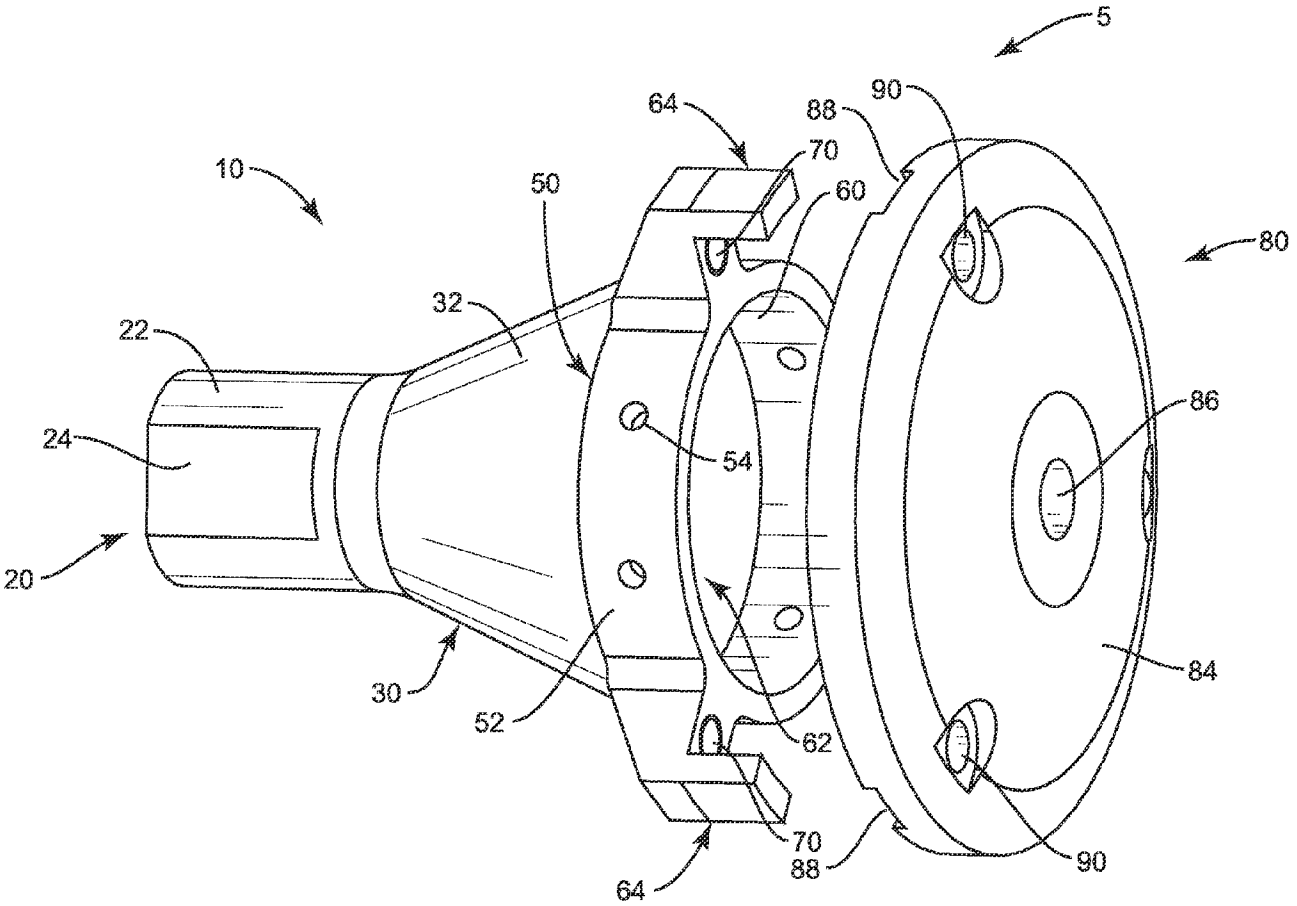
FIG. 1 is an exploded perspective view of a first embodiment of a muzzle brake.

Referring now to the drawings, exemplary embodiments of a muzzle brake are shown and indicated generally by the numeral 5. The muzzle brake 5 attaches to the end of a gun barrel (not shown) and is designed to reduce recoil when the gun is fired. For convenience, similar reference numbers are used in the description of the various embodiments to indicate similar components.

The muzzle brake 5 has two main components: a supersonic nozzle 10 and a reverser plate 80. The supersonic nozzle 10 attaches to the barrel of a gun and is designed to accelerate propellant gases exiting the gun barrel. The reverser plate 80 is mounted in spaced relationship to the supersonic nozzle 10 and is designed to allow passage of a bullet while redirecting the flow of the propelled gases in a partially rearward direction to reduce the recoil forces.

The supersonic nozzle 10 comprises an inlet section 20, expansion section 30, and outlet section 50. The inlet section 20 includes a generally cylindrical outer surface 22 having opposing flats 24 formed therein. The expansion section 30 comprises a generally frusto-conical or bell-shaped outer surface 32 that expands radially outward from the inlet section 20. The outlet section 50, if present, includes a generally cylindrical outer surface 52 that extends forwardly from the expansion section 30.

A threaded opening 26 is formed in the inlet section 20. The threaded opening 26 is sized to screw onto a gun barrel. Opposing flats 24 are formed on the outer surface 22, which may be engaged by a tool to tighten the supersonic nozzle 10 on the gun barrel.

An expansion chamber 36 is formed in the interior of the supersonic nozzle 10. The expansion chamber 36 includes an inlet 38 and an outlet 40 which are coaxially aligned with the threaded opening 26 in the inlet section 20. The inlet 38 has a relatively small diameter (compared to the outlet 40) that is approximately equal to the bore size of the gun barrel. The outlet 40 has a relatively large diameter (compared to the inlet 38). In one exemplary embodiment, the chamber wall 34 continuously diverges from the inlet 38 to the outlet 40. The inner wall 36 may have a generally conical shape that diverges at a constant angle from the inlet 38 to the outlet 40. Alternatively, the inner wall 38 may have a bell-shaped configuration (see FIG. 8) with a relatively large angle of divergence adjacent to the inlet 38 and a relatively smaller angle of divergence adjacent to the outlet 40. In a preferred embodiment, the interior volume of the expansion chamber 36 is unobstructed. That is, there is no structure within the volume of the expansion chamber 36 that would disrupt or alter the flow of gases within the interior volume of the expansion chamber 36.

Figure 2:
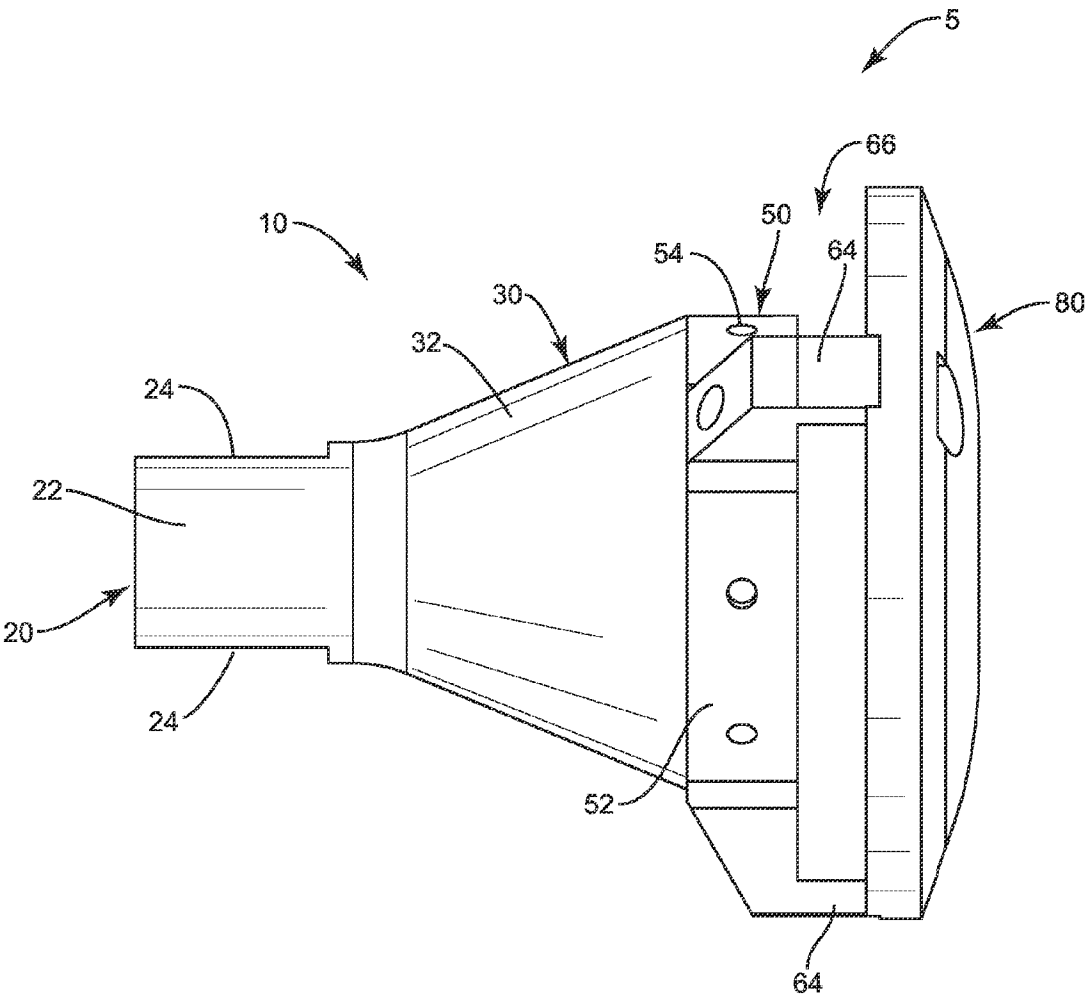
FIG. 2 is a side elevation view of the first embodiment of the muzzle brake.
Figure 3:
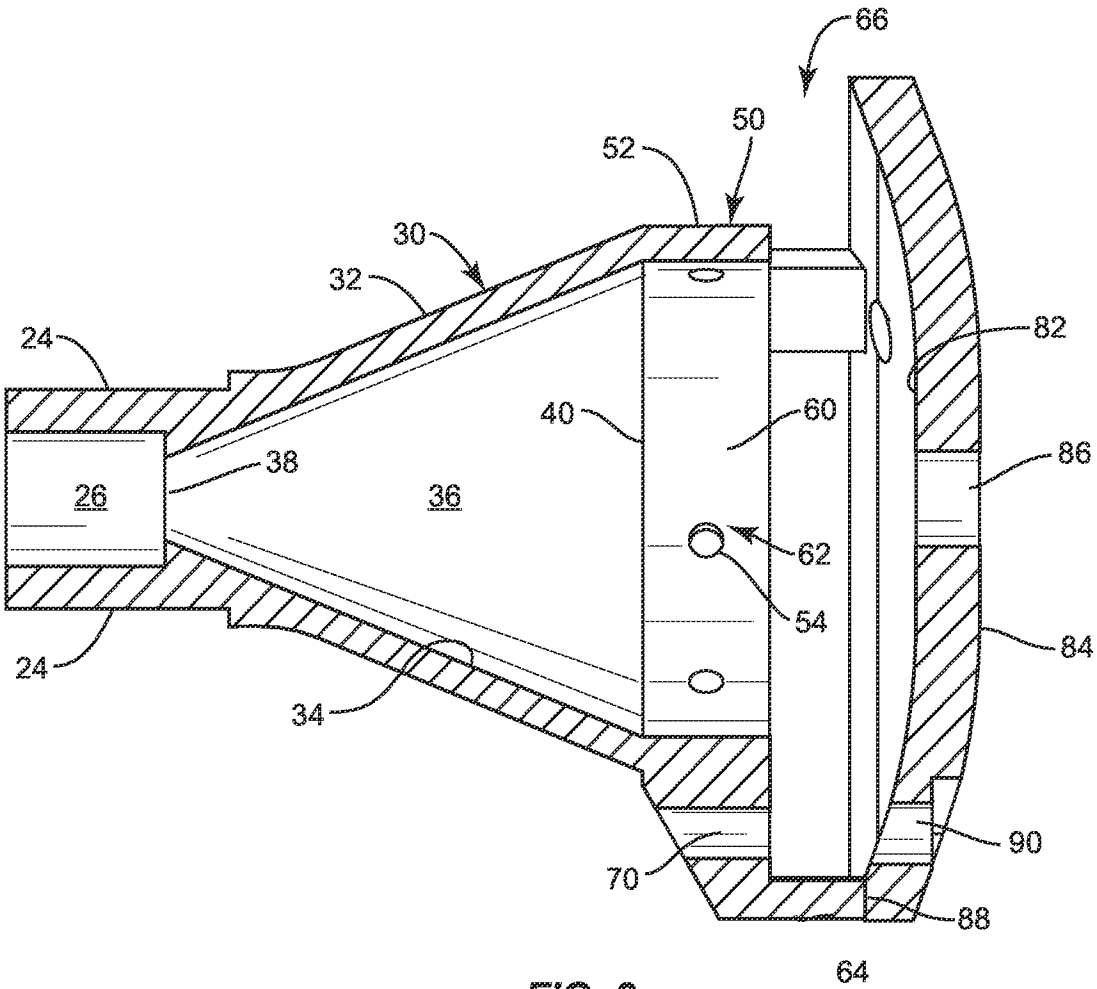
FIG. 3 is an section view of the first embodiment of the muzzle brake.
Figure 4:
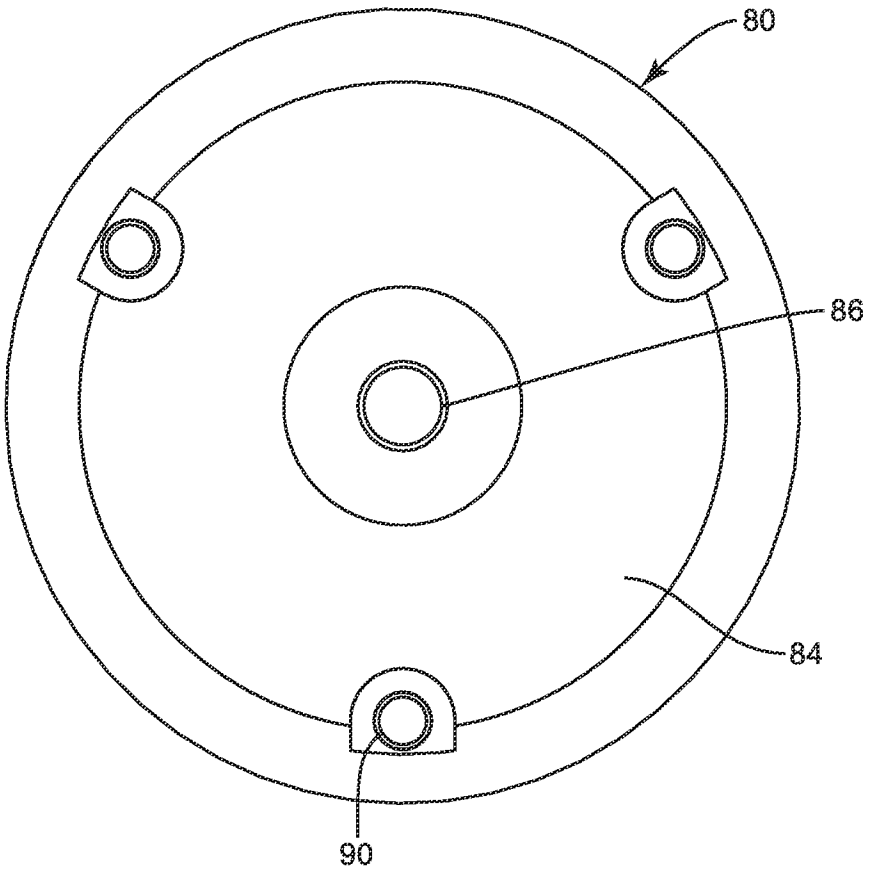
FIG. 4 is a front elevation view of the first embodiment of the muzzle brake.

In one exemplary embodiment, the expansion chamber 36 in a muzzle brake configured shown in FIGS. 1-3, has an inlet 38 approximately 0.26 inches in diameter and an outlet approximately 1.32 inches in diameter. The distance from the inlet 38 to the outlet 40 is 1.5 inches and the wall 34 of the expansion chamber 36 diverges at an angle of 26 degrees.

An exit opening 62 is formed in the outlet section 50. Preferably the diameter of the exit opening 62 is at least as large as the outlet 40 of the expansion chamber 36. In the embodiment shown in FIGS. 1-4, the exit opening 62 has a generally cylindrical configuration defined by the forward projection of the outlet 40 of the expansion chamber 36. The wall 60 of the exit opening is parallel to the axis of the supersonic nozzle 10 and the interior volume of the exit opening 62 is free of any internal structure, i.e., is unobstructed, that would interfere with or disrupt the flow of propellant gases.

In some embodiments, radial openings 54 extend from the inner wall 60 to the out surface 52. The radial openings 52 allow some of the propellant gases to escape through the radial openings 54. The propellant gases escaping from the radial openings 54 form an air curtain that reduces the blasé effect of the muzzle brake 5 as will be described in more detail below.

Three L-shaped supports 64 extend radially outward and forward from the outlet section 50. In one embodiment, the supports 64 preferably are disposed entirely outside of the forward projection of the outlet 40 so as not to interfere with or disrupt the flow of propellant gases. Bolt holes 70 are formed near the base of the supports 64 for use in securing the reverser plate 80 as hereinafter described.

The reverser plate 80 mounts to the outer end of the L-shaped supports 64. The reverser plate 80 has a generally circular configuration as seen from the front or rear. The diameter of the reverser plate 80 is preferably larger than the exit opening 62 of the supersonic nozzle 10. The inner surface 82 of the reverser plate 80 is concave while the outer surface 84 is convex. A bullet opening 86 is formed in the center of the reverser plate to allow passage of a bullet fired from the gun barrel. The inner surface 82 includes mounting recesses 88 that engage with the L-shaped supports 64 extended from the outlet section of the supersonic nozzle 10. The reverser plate 80 is secured by bolts 92 that pass through holes 90 in the reverser plate and thread into the bolt holes 70 in the outer section 50 of the supersonic nozzle 10. Thus, the reverser plate 80 may be removed for cleaning or replacement. The supports 64 support the reverser plate 80 in spaced relationship to the supersonic nozzle 10 so as to define an annular opening 66 adjacent the end of the supersonic nozzle 10. The size and concave shape of the reverser plate 80 redirect the propellant gases through the annular opening 66 so that the axial component of the velocity is in a rearward direction.

In operation, the supersonic nozzle 10 is attached to the barrel of a gun. When the gun is fired, the bullet travels through the expansion chamber 60 and passes unimpeded through the bullet opening 86 in the reverser plate 80. The velocity of the propellant gases exiting the gun barrel will be supersonic, i.e. greater than the speed of sound. The supersonic nozzle 10 is designed to function as a supersonic nozzle to accelerate the propellant gases in the expansion chamber 36. The propellant gases exiting the gun barrel enter the expansion chamber 36 of the supersonic nozzle 10 through the inlet 38. In contrast to subsonic flows, the expanding volume of the expansion chamber 36, when properly designed, will accelerate the propellant gases exiting the gun barrel. With proper design, the propellant gases may be accelerated as much as 2-3 times the initial velocity. Both the expansion chamber and the volume defined by the forward projection of the outlet 40 extending to the reverser plate is free of any internal structure so that the flow of propellant gases is unimpeded.

In the absence of the reverser plate 80, accelerating the velocity of the propellant gases would increase the recoil of the gun significantly. However, the reverser plate 80 is designed to redirect the expansion gases in a partially rearward direction so that the net contribution of the propellant gases to the recoil is negative. Some of the propellant gases will exit through the bullet opening 86 and the reverser plate 80. The propellant gases exiting through the bullet opening will add to the recoil. The remaining propellant gases will exit through the angular opening 66 between the supersonic nozzle 10 and reverser plate 80. The propellant gases exiting through the annular opening 66 will have both radial and axial components. The radial component of those propellant gases neither increases nor decreases the recoil. The axial component of the propellant gases should be in the reverse direction and large enough to offset the recoil from the propellant gases exiting the bullet opening 92. When the net axial component of the propellant gas flow is negative, the propellant gases do not contribute to the recoil and reduce the recoil attributable to the bullet.

As noted above, some of the propellant gases are redirect back towards the user. This is known as the blast effect. To reduce the blast effect, radial openings 54 may be provided in the outlet section 50 of the supersonic nozzle 10. Propellant gases escaping through the radial openings 54 form an air curtain that blocks or redirects some of the propellant gases flowing towards the user.

Figure 5:
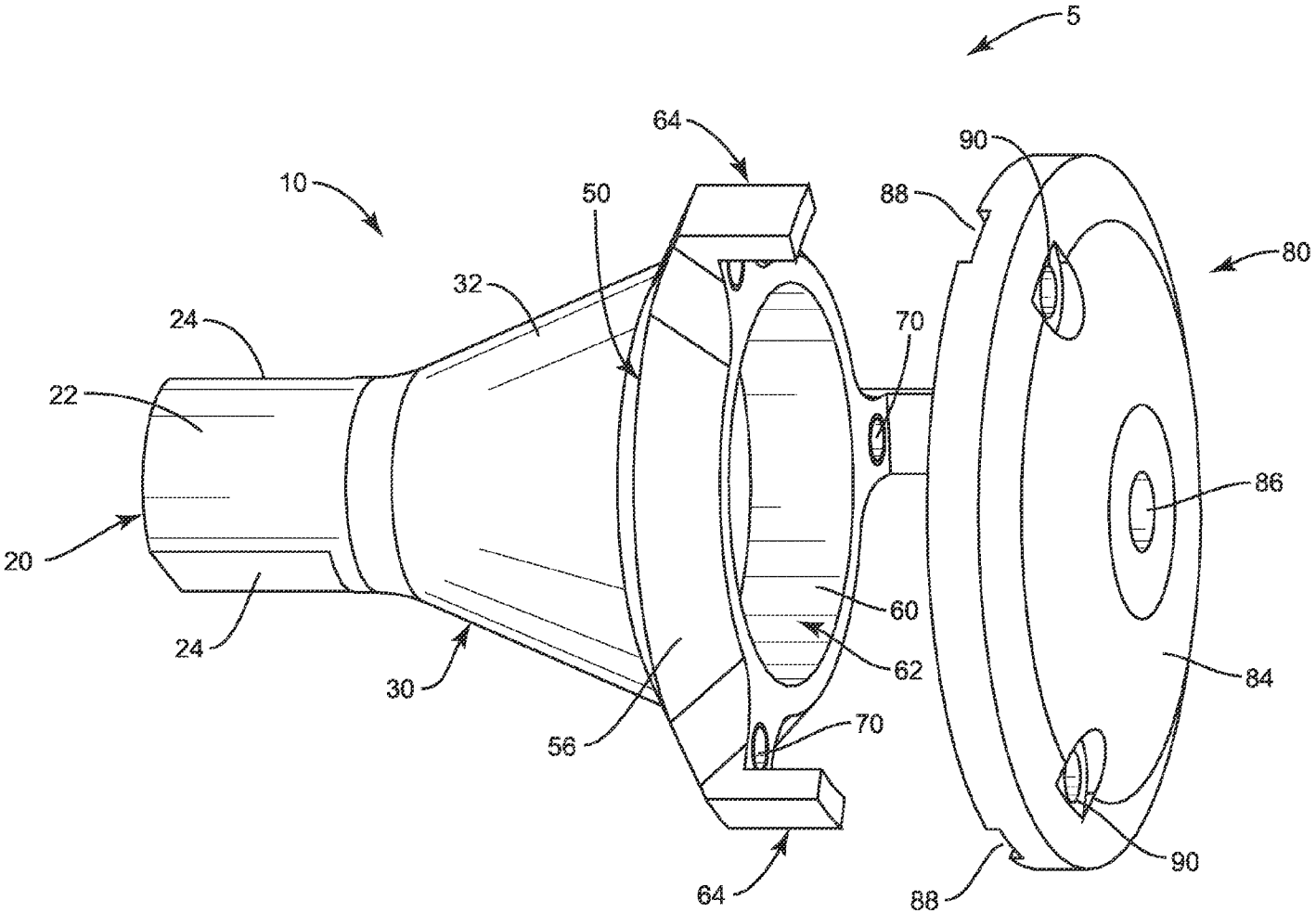
FIG. 5 is an exploded perspective view showing a second embodiment of a muzzle brake.
Figure 6:
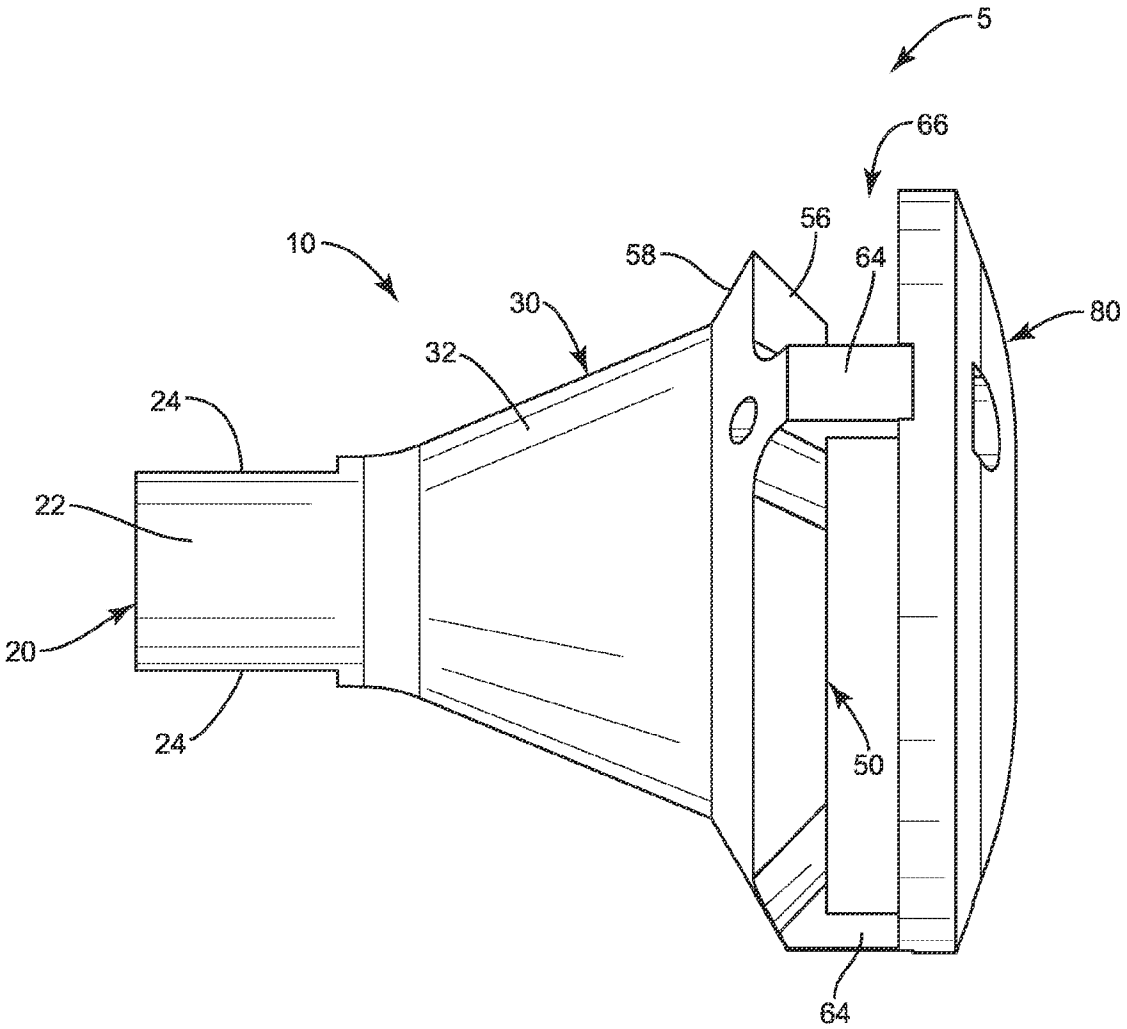
FIG. 6 is a side elevation view of the second embodiment of the muzzle brake.
Figure 7:
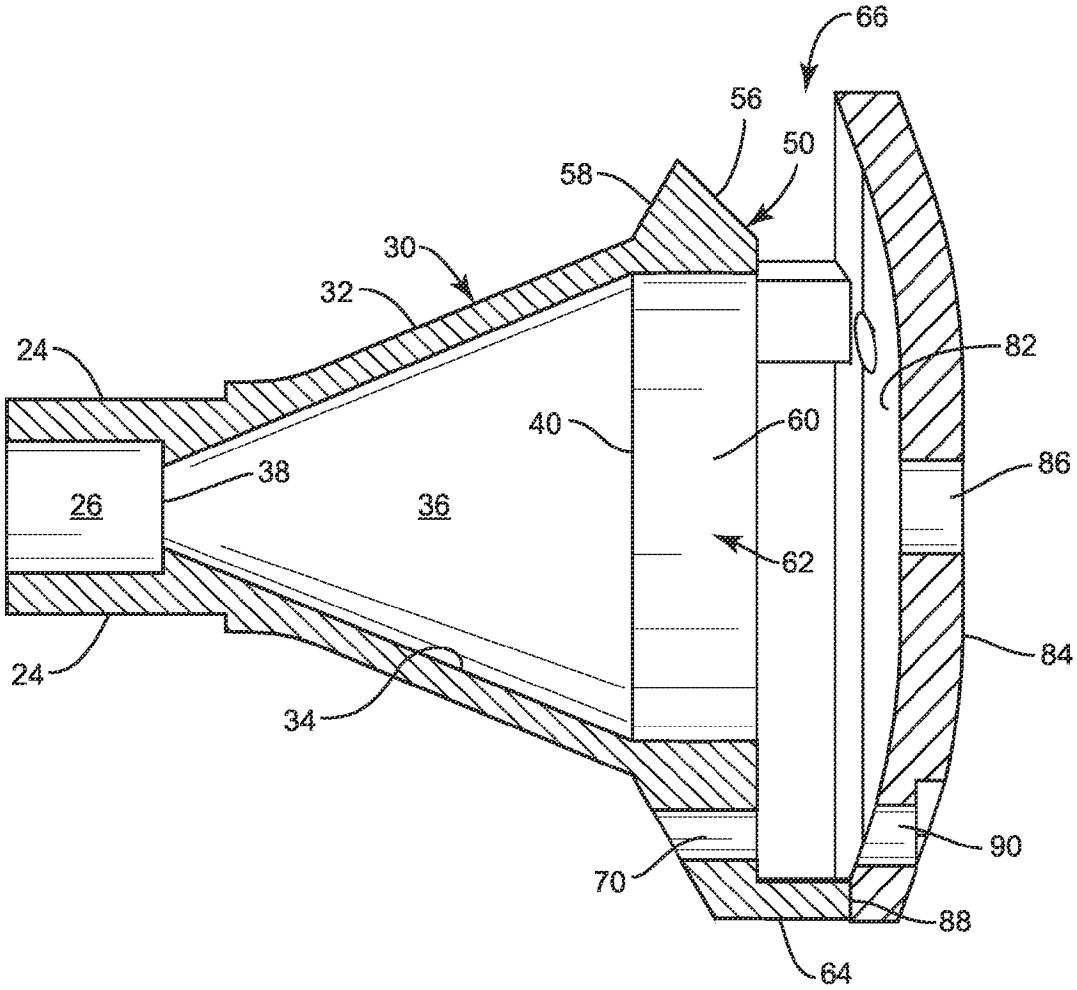
FIG. 7 is an section view of the second embodiment of the muzzle brake.

FIG. 5-7 illustrates an alternate embodiment of the muzzle brake 5. For convenience, similar reference numbers have been used to indicate similar components. The muzzle brake 10 illustrated in FIGS. 5-7 comprises a supersonic nozzle 10 and reverser plate 80 which are essentially the same as previously described with some modification to the supersonic nozzle 10.

In the embodiment shown in FIGS. 5-7, the supersonic nozzle 10 includes an inlet section 20 and expansion section 30 as previously described. The outlet section 50, in contrast to the first embodiment, comprises two beveled outer surfaces 56 and 58 in place of the cylindrical surface 52. The supersonic nozzle 10 includes a threaded opening 26, expansion chamber 36 and outlet opening 62 as previously described. The reverser plate 80 is supported in spaced relationship to the exit opening 62 by supports 64 that extend radially outward and forward from the supersonic nozzle 10. Other features previously described are shown in FIGS. 5-7 and for sake of brevity the detailed description of those features is not repeated here.

In use, propellant gases exiting the gun barrel when the gun is fired enter the expansion chamber 36 of the supersonic nozzle 10 through the inlet 38. The propellant gases are accelerated in the expansion chamber 36. The reverser plate 80 redirects the propellant gases through the annular opening 66 between the end of the supersonic nozzle 10 and the reverser plate 80. The net axial component of the gas flow exiting through the annular opening 66 will be in a rearward direction, i.e., towards the user. The beveled outer surface 56 forces the propellant gas to flow around the radially projecting surface thus increasing the radial component of the propellant gas flow. Increasing the radial component of the gas flow reduces the blast effect because most of the gas flow passes to the sides or over the head of the user.

Figure 8:
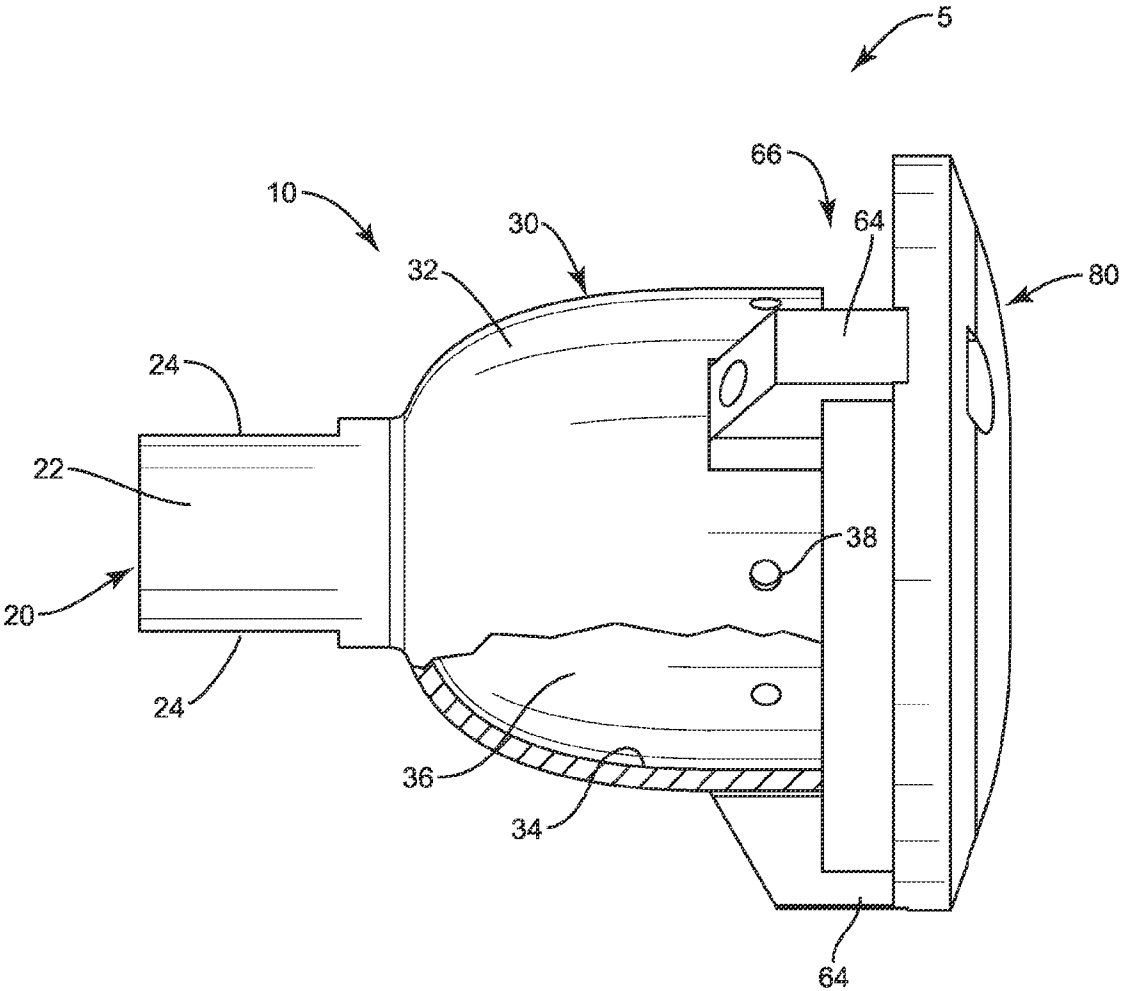
FIG. 8 is an exploded perspective view showing a third embodiment of a muzzle brake.

FIG. 8 illustrates another embodiment of the muzzle brake 5 having a bell-shaped rather than conical expansion chamber 36. For convenience, similar reference numbers have been used to indicate similar components. The muzzle brake 10 illustrated in FIG. 8 comprises a supersonic nozzle 10 and reverser plate 80 which function as previously described. The supersonic nozzle 10 includes an inlet section 20 and expansion section 30 as previously described. This embodiment does not include a distinct outlet section. The supersonic nozzle 10 includes a threaded opening 26, bell-shaped expansion chamber 36 and outlet opening 62. The bell-shaped expansion chamber 36 has a continuously diverging wall 32. The angle of diverge is relatively large near the inlet 38 and relatively small at the outlet. In this embodiment, there is no need for a separate outlet section 50. In some embodiments, radial openings 38 may be formed in the wall of the expansion section 30. The reverser plate 80 is supported in spaced relationship to the exit opening 62 by supports 64 that extend radially outward and forward from the supersonic nozzle 10. Other features previously described are shown in FIG. 8 and for sake of brevity the detailed description of those features is not repeated here.

In use, propellant gases exiting the gun barrel when the gun is fired enter the expansion chamber 36 of the supersonic nozzle 10 through the inlet 38. The propellant gases are accelerated in the expansion chamber 36. The reverser plate 80 redirects the propellant gases through the annular opening 66 between the end of the supersonic nozzle 10 and the reverser plate 80. The net axial component of the gas flow exiting through the annular opening 66 will be in a rearward direction, i.e., towards the user. Propellant gases escaping through the radial openings 36 form an air curtain as previously described to reduce the blast effect by blocking some of the propellant gases flowing in a rearward direction.

Figure 9:
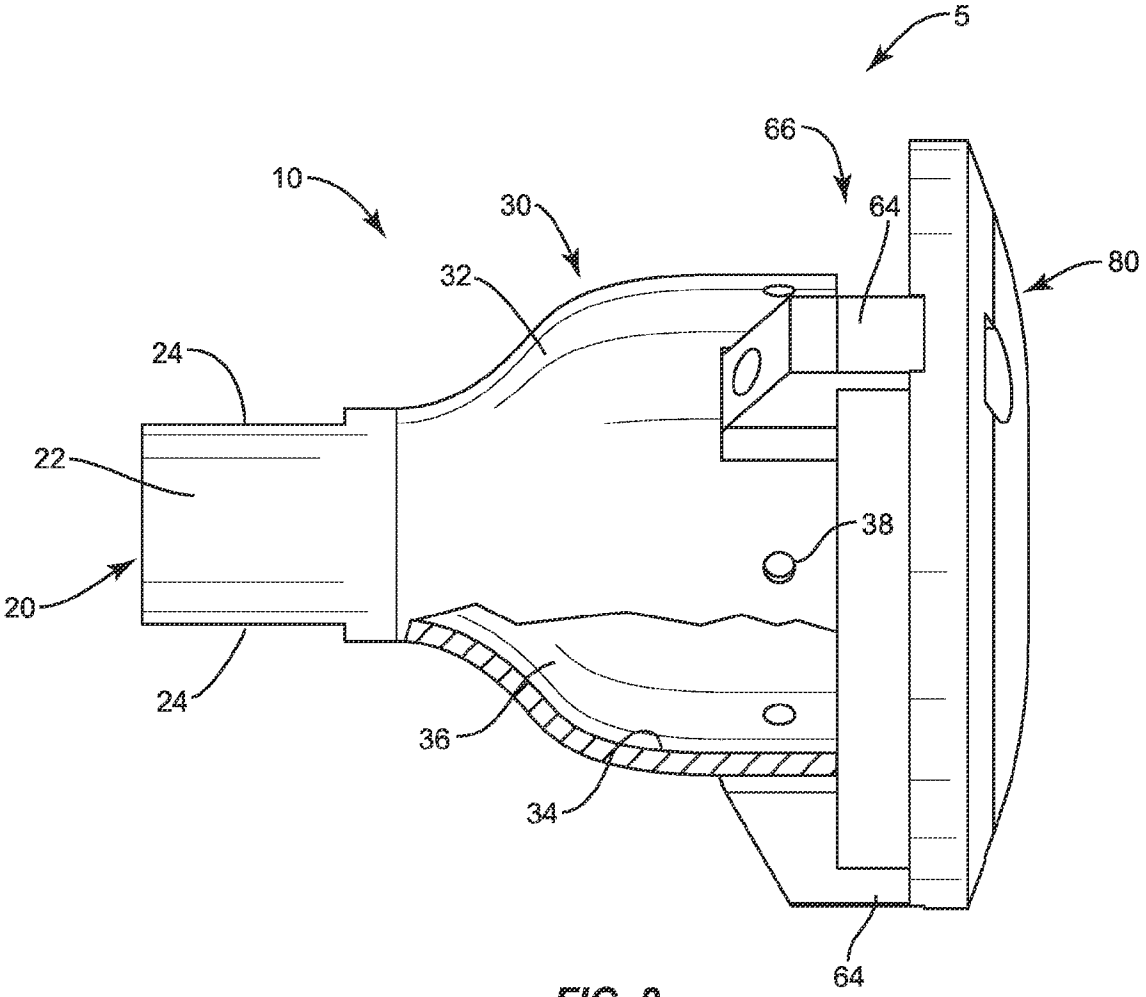
FIG. 9 is an exploded perspective view showing a fourth embodiment of a muzzle brake.

FIG. 9 illustrates another embodiment of the muzzle brake 5 having a bell-shaped rather than conical expansion chamber 36. This embodiment is similar to the embodiment shown in FIG. 8. For convenience, similar reference numbers have been used to indicate similar components.

The muzzle brake 10 illustrated in FIG. 9 comprises a supersonic nozzle 10 and reverser plate 80 which function as previously described. The supersonic nozzle 10 includes an inlet section 20 and expansion section 30 as previously described. This embodiment does not include a distinct outlet section. The supersonic nozzle 10 includes a threaded opening 26, bell-shaped expansion chamber 36 and outlet opening 62. The bell-shaped expansion chamber 36 has a continuously diverging wall 32 with a compound curvature. The wall 32 of the expansion chamber 36 in this embodiment has a first portion adjacent the inlet 38 with a convex curvature and a second portion adjacent the outlet with a concave curvature. The point where the curvature changes from convex to concave is referred to as the inflection point. In the first portion, extending from the inlet to the inflection point, the angle of divergence begins small and increases as the wall 32 extends forwardly. In the second portion, extending from inflection point to the outlet 40, the angle of divergence begins large and decreases as the wall 32 extends forwardly. The reverser plate 80 is supported in spaced relationship to the exit opening 62 by supports 64 that extend radially outward and forward from the supersonic nozzle 10. Other features previously described are shown in FIG. 8 and for sake of brevity the detailed description of those features is not repeated here.

In use, propellant gases exiting the gun barrel when the gun is fired enter the expansion chamber 36 of the supersonic nozzle 10 through the inlet 38. The propellant gases are accelerated in the expansion chamber 36. The convex portion generates expansion shock waves while the concave portion generates compression shock waves. When properly designed, the expansion shock waves and compression shock waves cancel and improve the supersonic flow. The reverser plate 80 redirects the propellant gases through the annular opening 66 between the end of the supersonic nozzle 10 and the reverser plate 80. The net axial component of the gas flow exiting through the annular opening 66 will be in a rearward direction, i.e., towards the user. Propellant gases escaping through the radial openings 36 form an air curtain as previously described to reduce the blast effect by blocking some of the propellant gases flowing in a rearward direction.

The geometry and design of supersonic nozzles is discussed in detail in the following references:

Ivan E. Beckwith and John A. Moore, "An Accurate And Rapid Method For The Design Of Supersonic Nozzles,"

technical note 3322, National Advisory Committee for Aeronautics, Langley Aeronautical Laboratory, Langley Field, Va. February 1955;

J. C. Crown and W. H. Heybey, "Supersonic Nozzle Design," Naval Ordnance Laboratory Memorandum 10594, U.S. Naval Ordnance Laboratory, White Oak, Silver Spring 19, Maryland. April 1950.

These references are incorporated herein in their entirety by reference.

What is claimed is:

1. A muzzle brake comprising:

a supersonic nozzle adapted to attach to the end of a gun barrel, said supersonic nozzle including an expansion chamber having an inlet and an outlet, said expansion chamber being configured to accelerate gases exiting the end of the barrel when the gun is fired;

a reverser plate spaced from the supersonic nozzle and configured to redirect the flow of the gases exiting the supersonic nozzle;

an opening in the reverser plate for permitting a bullet exiting the barrel to pass through the reverser plate; and an annular opening between the supersonic nozzle and the reverser plate to allow the escape of the propellant gases exiting the supersonic nozzle.

2. The muzzle brake of claim 1 wherein the expansion chamber has a continuously diverging wall.

3. The muzzle brake of claim 2 wherein the expansion chamber has a bell-shaped wall with a variable angle of divergence.

4. The muzzle brake of claim 3 wherein the expansion chamber includes a first section wherein the wall of the expansion chamber is convexly curved and a second section wherein the wall of the expansion chamber is concavely curved.

5. The muzzle brake of claim 2 wherein the expansion chamber has a conical wall with a constant angle of divergence.

6. The muzzle brake of claim 1 wherein the interior volume of the expansion chamber is free of any internal structure.

7. The muzzle brake of claim 1 wherein a volume defined by a forward protection of the outlet extending to the reverser plate is free of any internal structure.

8. The muzzle brake of claim 1 wherein the expansion chamber and a volume defined by a forward protection of the expansion chamber outlet extending to the reverser plate are free of any internal structure.

9. The muzzle brake of claim 1 further comprising a plurality of radial openings to allow passage of propellant gases, said radial openings arranged so that the propellant gases exiting the radial openings form an air curtain to reduce a blast effect of the brake muzzle.

10. The muzzle brake of claim 1 wherein the supersonic nozzle further comprises an outlet section extending forward from the expansion chamber and including an exit opening having a diameter equal to or greater than a diameter of the outlet of the expansion chamber.

11. The muzzle brake of claim 10 wherein the outlet section includes a plurality of radial opening to allow passage of propellant gases, said radial openings arranged so that the propellant gases exiting the radial openings form an air curtain to reduce a blast effect of the brake muzzle.

12. The muzzle brake of claim 10 wherein the outlet section includes a beveled outer surface adjacent the annular opening and extending radially outward for directing propellant gases away from a user.

13. The muzzle brake of claim 1 further comprising a plurality of supports for supporting the reverser plate in spaced relationship to the end of the supersonic nozzle, said supports projecting radially outward from the supersonic nozzle and outside of a volume defined by the forward projection of the outlet.

14. The muzzle brake of claim 1 wherein the reverser plate is removably mounted to the supersonic nozzle.

15. The muzzle brake of claim 1 wherein the reverser plate is generally circular and has a diameter greater than a diameter of the exit opening of the propellant chamber.

16. The muzzle brake of claim 1 wherein the reverser plate includes a concave inner surface configured to redirect the flow of propellant gases in a partially rearward direction.

* * * * *